US006033261A

United States Patent [19]

Wakata et al.

[11] Patent Number: 6,033,261

[45] **Date of Patent: *Mar. 7, 2000**

[54] RUBBER PLUG FOR WATERPROOF CONNECTOR

[75] Inventors: Shigekazu Wakata; Eiji Saijo, both of Yokkaichi, Japan

[73] Assignee: Sumitomo Wiring Systems, Ltd., Mie, Japan

[ * ] Notice: This patent is subject to a terminal disclaimer.

[21] Appl. No.: 08/249,931

[22] Filed: May 26, 1994

[30] Foreign Application Priority Data

Jun. 14, 1993 [JP] Japan ..... 5-168437

[51] Int. Cl.[7] ..... H01R 13/40

[52] U.S. Cl. ..... 439/587

[58] Field of Search ..... 439/587, 274, 439/275

[56] References Cited

U.S. PATENT DOCUMENTS

| | | | |
|---|---|---|---|
| 4,560,219 | 12/1985 | Chapelot | 439/587 OR |
| 4,643,506 | 2/1987 | Kobler . | |
| 4,828,509 | 5/1989 | Vogel . | |
| 4,902,247 | 2/1990 | Suzuki et al. | 439/595 |
| 5,066,242 | 11/1991 | Martucci | 439/587 X |
| 5,098,315 | 3/1992 | Slowen | 439/587 OR |
| 5,224,875 | 7/1993 | Watanabe et al. | 439/587 OR |

FOREIGN PATENT DOCUMENTS 2 415 375 8/1979 France .

*Primary Examiner*—Paula Bradley
*Assistant Examiner*—Daniel Wittels
*Attorney, Agent, or Firm*—Oliff & Berridge, PLC

[57] ABSTRACT

A double collar portion formed on a rubber plug intermediate opposite ends thereof and an umbrella-shaped end plug formed at a rear end of the rubber plug improve waterproofing in an electrical terminal. The collar portion is held in intimate contact with an inner peripheral surface of a tubular terminal-receiving chamber to form a seal therebetween. An open end of the tubular terminal-receiving chamber is closed by the end plug without a gap or recess, thereby eliminating the possibility of collection of water and virtually eliminating the possibility of water leaking into the terminal.

1 Claim, 3 Drawing Sheets

RUBBER PLUG FOR WATERPROOF CONNECTOR

BACKGROUND OF THE INVENTION

This invention relates to a rubber plug for a waterproof connector and more particularly to a rubber plug wherein the plug forms a seal between a housing and a wire within the waterproof connector.

One known rubber plug for a waterproof connector is shown in FIGS. 4 and 5. A rubber plug 2 of a cylindrical shape having a through hole 2*a* extending along a centerline thereof for passing a wire 1 therethrough has two flange-like collars 2*b* formed at a rear end portion 7 thereof. A front end portion 5 of the rubber plug has an outer diameter such that the front end portion 5 can be compressively clamped by an insulation barrel 3*a* of a terminal 3 with the wire 1 passing through the front end portion 5.

On the other hand, a connector housing 4 (FIG. 5) has a tubular terminal-receiving chamber 4*a* for retaining and holding the terminal at its front portion 8, the terminal receiving chamber having an open rear end portion 9. The open rear end portion 9 has a diameter such that the collars 2*b* are held in tight contact with the peripheral wall when the rubber plug 2 and the wire 1 are inserted into the housing 4.

The wire 1 is passed through the through hole 2*a* of the rubber plug 2, and a covering or insulating material is peeled from the front end portion 5 of the wire. The front end portion 5 of the rubber plug 2 is fixedly secured to the insulation barrel 3*a* of the terminal 3 by compressive clamping, and a conductor or exposed portion of the wire 1 is connected to a wire barrel 6 of the terminal 3 by compressive clamping. When the terminal 3 is inserted into the terminal receiving chamber 4*a* of the connector housing 4, the terminal 3 defining the leading side is retained at the inner end portion of the terminal receiving chamber 4*a*, and the rubber plug 2 at the rear end 9 of the terminal is received in the terminal receiving chamber 4*a* in intimate contact with the peripheral wall of the chamber, with the collars 2*b* being slightly elastically deformed.

When water is poured on the open end 9 of the terminal receiving chamber 4*a*, the intrusion of the water is prevented because of the intimate contact between the peripheral wall of the terminal receiving chamber 4*a* and the collars 2*b* of the rubber plug 2, thereby achieving a waterproof effect.

In the above conventional rubber plug for a waterproof connector, however, if the rear end face 7 of the rubber plug 2 is not flush with the open end of the terminal receiving chamber 4*a*, a water collecting recess R may be formed. In such a case, when the wire vibrates, although water will not intrude immediately, a gap is formed between the collars 2*b* and the peripheral wall of the terminal receiving chamber 4*a*. This vibration allows the collected water to intrude into the terminal receiving chamber 4*a*.

SUMMARY OF THE INVENTION

An object of the present invention is to provide a rubber plug for a waterproof connector that overcomes the above-described problems in the conventional plug and more surely prevents water from collecting and seeping into the terminal.

To achieve the above object, there is provided a rubber plug for a waterproof connector wherein the rubber plug having a wire passed therethrough is inserted, together with the wire into a tubular portion of the waterproof connector, thereby forming a seal between a wall of the tubular portion and the wire; and an end plug is provided at that side where an open end of the tubular portion is disposed so that the end plug can close the open end. As a further aspect, the end plug is formed into an umbrella shape to cover the open end.

According to another aspect of the present invention, there is provided in combination with a waterproof connector having a housing within which is disposed a tubular passage for receiving a wire terminal, a plug for forming a seal between the tubular passage and the wire terminal and an end plug coupled to the plug for covering an end of the tubular passage.

In accordance with yet another aspect of the present invention, there is provided a waterproof seal for use in an electrical connector having a tubular passage for receiving a wire terminal and including a main plug portion for forming a seal between the wire terminal and tubular passage and an end plug connected to the main plug for covering an end of the tubular passage.

In the invention of the above construction, when the rubber plug is inserted into the tubular portion of the waterproof connector, the end plug formed at that side where the open end of the tubular portion is disposed closes the open end thereby eliminating the possibility of collection of water at the open end portion. In addition, the umbrella shape of the end plug covers the entire open end portion.

As described above, in the present invention, the open end of the tubular portion is waterproofed by closing the end plug thus preventing water from collecting and seeping into the terminal. Accordingly, even vibrations that may cause gaps to form between the peripheral wall of the tubular portion and the rubber plug will not cause water leakage. Furthermore, the end plug covers the entire open end portion. With this feature, the plug can be attached with a smaller force as compared with the type of construction in which a plug is pushed in for closing purposes.

BRIEF DESCRIPTION OF THE DRAWINGS

The invention will be described with reference to the following drawings wherein.

DETAILED DESCRIPTION OF PREFERRED EMBODIMENTS

Figure 1:
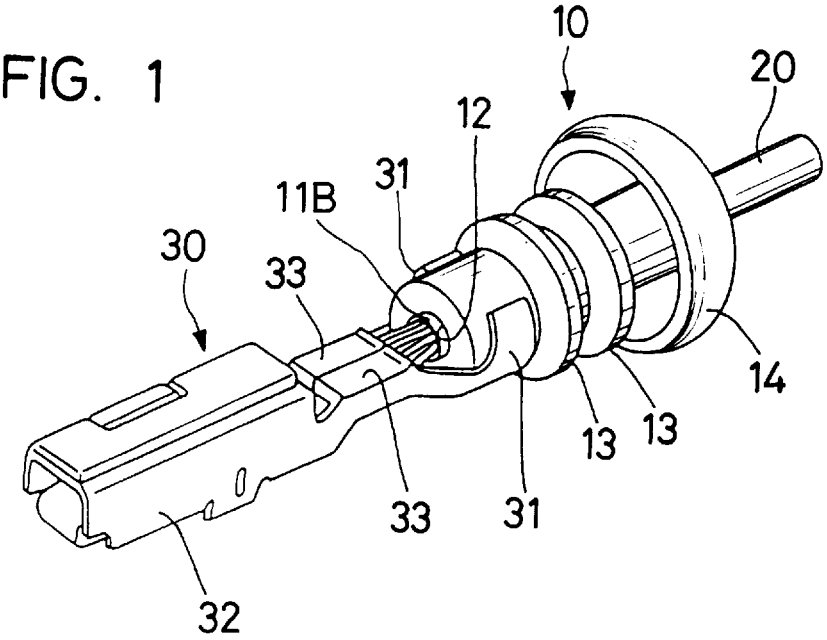
FIG. 1 is a perspective view of one preferred embodiment of a rubber plug of the present invention for a waterproof connector.
Figure 2:
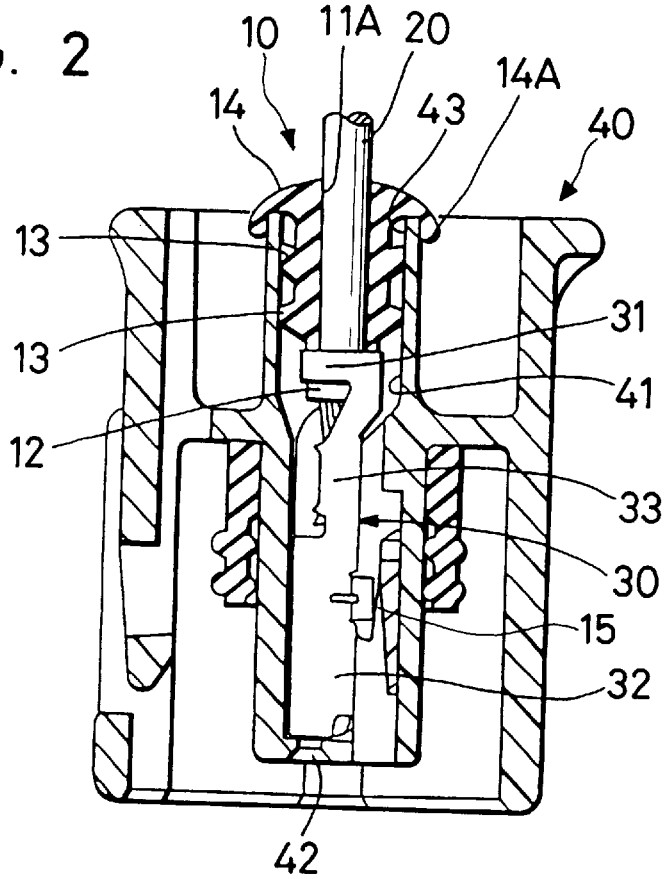
FIG. 2 is a cross-sectional view of the plug attached to a waterproof connector housing.

FIG. 1 is a perspective view of one preferred embodiment of a rubber plug of the present invention for a waterproof connector, and FIG. 2 is a cross-sectional view showing the plug attached to a waterproof connector housing.

In the drawings, a rubber plug 10 includes a cylindrical body 12 having a through hole 11A extending along a centerline thereof for passing a wire 20 therethrough. Two flange-like hollow collars 13 are formed on and project outwardly from the body 12. The collars 13 are disposed at a generally central portion of the body 12 in the axial direction. An umbrella-shaped end plug 14 is formed at a rear end of the rubber plug, with a convex face of the end plug 14 directed forwardly.

An outer periphery of a front end portion of the rubber plug 10 is defined by a smooth cylindrical surface. The front end portion has a diameter such as to be compressively clamped by an insulation barrel 31 of a terminal 30. A female terminal portion 32 is formed at a front end portion of the terminal 30, and a wire barrel 33 is formed between the terminal portion 32 and the insulation barrel 31.

A waterproof connector housing 40 has a terminal receiving chamber 41 in the form of a hollow tube. An opening 42 for passing a mating terminal therethrough is formed in a front end (shown at a lower side) of the terminal receiving chamber 41, and an opening 43 for passing the terminal 30 therethrough is formed at a rear end of the terminal receiving chamber 41. The rear open end portion 43 of the terminal receiving chamber 41 is formed into a cylindrical shape and the diameter of the umbrella-shaped end plug 14 is greater than the diameter of the rear open end portion 43 so as to cover the entire open end 43. A lock piece 15 for retaining the terminal 30 is provided within the terminal receiving chamber 41 at its front portion.

The operation of the embodiment of the above construction will now be described.

First, the wire 20 is passed through the through hole 11A of the rubber plug 10 from that side of the rubber plug where the umbrella-shaped end plug 14 having a lip portion 14A is formed, and a wire insulator or covering material is peeled from that portion of the wire projected from the other side 11B, thereby exposing a conductor. The cylindrical front end portion of the rubber plug 10 is put on the insulation barrel 31 of the terminal 30, and the insulation barrel 31 is compressively deformed, thus clamping the exposed ends of the wire 20 in the wire barrel 33.

After the wire 20 and the terminal 30 are connected, the terminal 30 is inserted into the terminal receiving chamber 41 of the waterproof connector housing 40. During the insertion of the rubber plug 10, the cylindrical body 12 freely passes through opening 43, whereas the two collars 13 are kept in intimate contact with the inner peripheral surface of the terminal receiving chamber 41.

Immediately before the terminal 30 is inserted into a predetermined position, the umbrella-shaped end plug 14 of the rubber plug 10 is brought into abutting engagement with the opening portion 43 of the terminal receiving chamber 41. Then, the rubber plug is further pushed until the terminal 30 becomes retained, so that the peripheral edge of the opening 43 is pressed into intimate contact with the inner surface of the umbrella-shaped end plug 14. In this condition, even if water is poured on those portions in the vicinity of the end of the terminal receiving chamber 41, water will not collect at the opening 43 since the opening is entirely covered with the umbrella portion of plug 14. Therefore, water will not intrude into the terminal receiving chamber 41.

Figure 3:
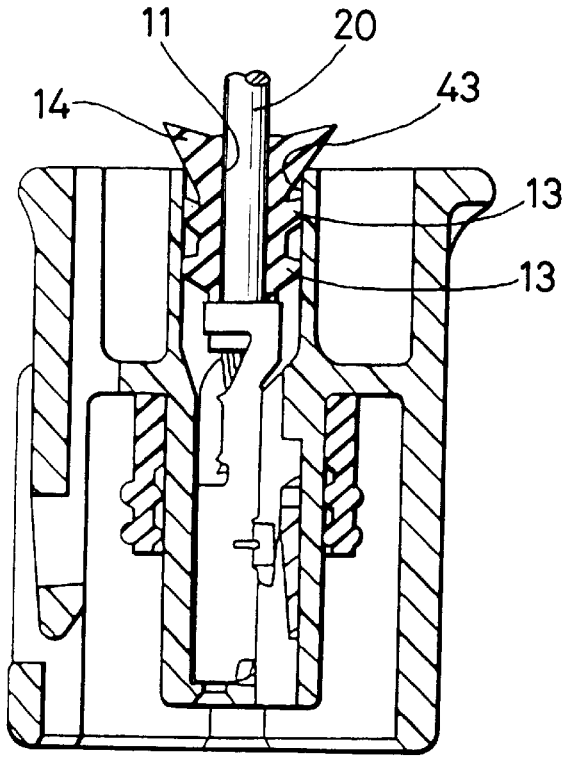
FIG. 3 is a cross-sectional view showing a second preferred embodiment of the present invention.
Figure 4:
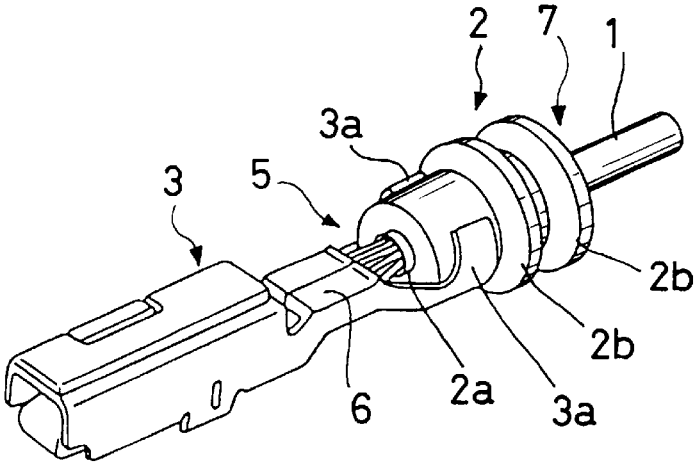
FIG. 4 RELATED ART
FIG. 4 is a perspective view of a conventional rubber plug for a waterproof connector.
Figure 5:
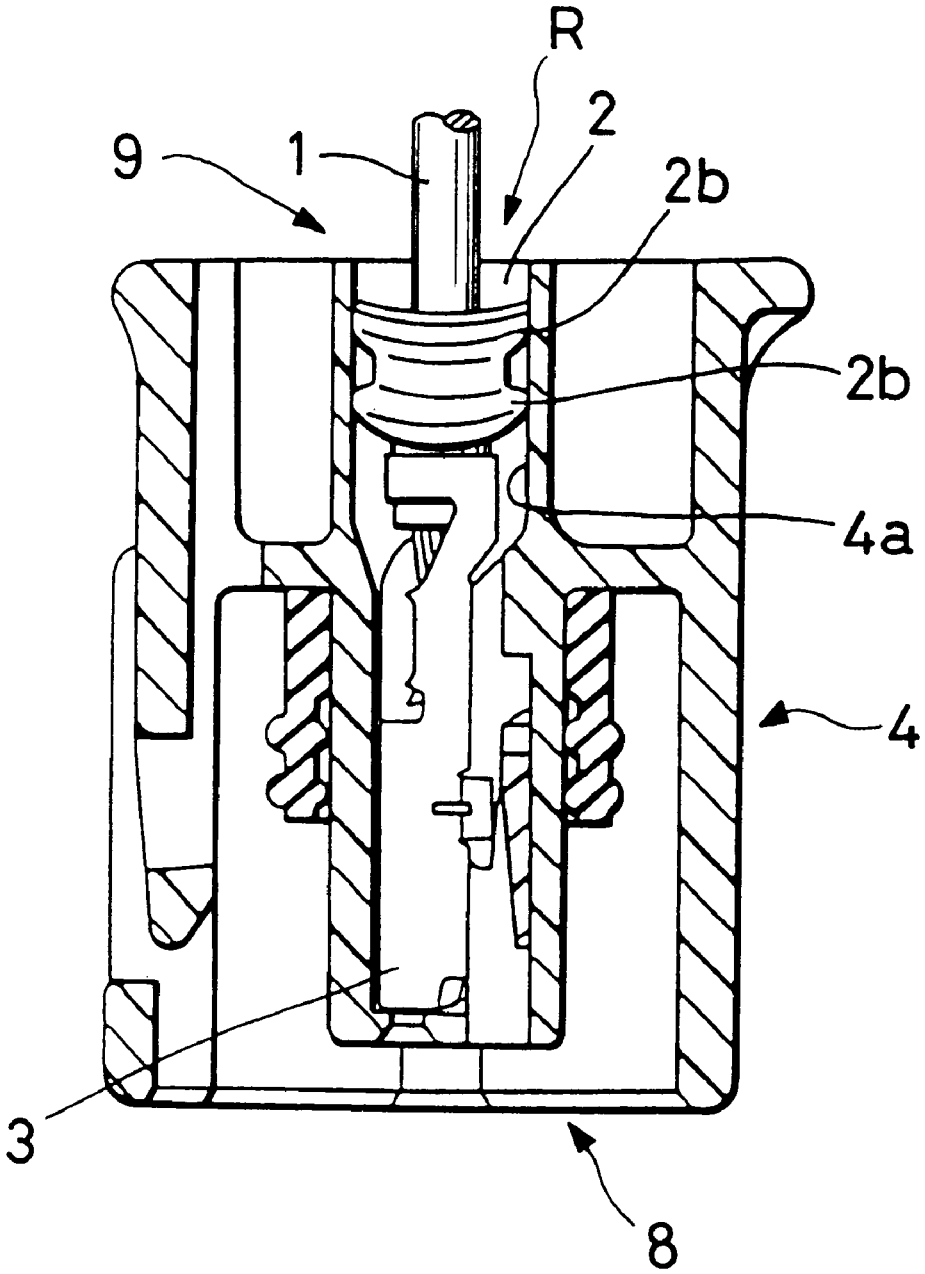
FIG. 5 RELATED ART
FIG. 5 is a cross-sectional view showing the conventional rubber plug in a waterproof connector.

In the above embodiment, the end plug 14 is formed into an umbrella shape, and the end of the tubular portion is abutted against the inner peripheral surface of the umbrella portion to impart thereto an opposite force, so that a reaction force acts to keep the intimate contact. The plug for closing the opening, however, may be tapered in such a manner as shown in a second preferred embodiment of the invention in which the diameter progressively increases, as shown in FIG. 3. In this embodiment, the rubber plug is not maintained in a prestressed state.

As described above, the collars 13 are held in intimate contact with the inner peripheral surface of the tubular terminal receiving chamber 41. In addition, the open end of tubular portion is closed by the end plug, with no gap or recess formed, thereby eliminating the possibility of collection of water.

While the invention has been described in detail with reference to preferred embodiments thereof, which are intended to be illustrative but not limiting, various changes may be made without departing from the spirit and scope of the invention, which is defined in the following claims.

What is claimed is:

1. A waterproof seal for use in an electrical connector having a tubular passage for receiving a wire terminal, the waterproof seal comprising:

a main plug portion that forms a seal between a wire of the wire terminal and the tubular passage, said main plug comprising a hollow rubber body having a pair of flange-like collars sealably engageable with an inner wall surface of said tubular passage; and an end plug connected to said main plug and covering an end of the tubular passage, wherein said end plug comprises a hollow rubber body having a lip portion that extends outside the inner wall surface of said tubular passage, said end plug includes a first portion having a diameter greater than a diameter of the pair of flange-like collars and a diameter of the tubular passage, a second portion having a diameter equal to both the diameter of the tubular passage and the diameter of the pair of flange-like collars in the tubular passage, and a third portion having a diameter less than the diameter of the tubular passage and the diameter of the pair of flange-like collars;

wherein said lip portion of said end plug includes an outer surface and an upper surface, the outer surface contacting the inner wall surface of said tubular passage, and the outer surface being continuously outwardly tapered from said pair of flange-like collars such that a diameter of said end plug continuously increases between said pair of flange-like collars and said upper surface.

* * * * *